US007988600B2

(12) United States Patent
Rodgers, Jr.

(10) Patent No.: US 7,988,600 B2
(45) **Date of Patent: *Aug. 2, 2011**

(54) ADJUSTABLE GEOMETRY EXERCISE DEVICES AND METHODS FOR USE THEREOF

(76) Inventor: Robert E. Rodgers, Jr., Canyon Lake, TX (US)

( * ) Notice: Subject to any disclaimer, the term of this patent is extended or adjusted under 35 U.S.C. 154(b) by 197 days.

This patent is subject to a terminal disclaimer.

(21) Appl. No.: 12/116,872

(22) Filed: May 7, 2008

(65) Prior Publication Data

US 2009/0203501 A1 Aug. 13, 2009

Related U.S. Application Data

(60) Provisional application No. 60/928,619, filed on May 10, 2007, provisional application No. 61/072,564, filed on Apr. 1, 2008.

(51) Int. Cl.
*A63B 22/00* (2006.01)
*A63B 23/04* (2006.01)

(52) U.S. Cl. ..... 482/52; 482/57; 482/70

(58) Field of Classification Search ..... 482/51–53, 482/57, 70, 79–80, 148
See application file for complete search history.

(56) References Cited

U.S. PATENT DOCUMENTS

| | | | | |
|---|---|---|---|---|
| 1,166,304 | A | 12/1915 | Albert | |
| 4,940,233 | A | 7/1990 | Bull et al. | |
| 5,611,756 | A | 3/1997 | Miller | |
| 5,735,773 | A | 4/1998 | Vittone et al. | |
| 5,795,268 | A | 8/1998 | Husted | |
| 5,910,072 | A | 6/1999 | Rawls et al. | |
| 5,967,944 | A | 10/1999 | Vittone et al. | |
| 5,989,163 | A | 11/1999 | Rodgers, Jr. | |
| 6,004,244 | A | 12/1999 | Simonson | |
| 6,036,622 | A | 3/2000 | Gordon | |
| 6,045,487 | A * | 4/2000 | Miller | 482/52 |
| 6,113,518 | A | 9/2000 | Maresh et al. | |
| 6,152,859 | A | 11/2000 | Stearns | |
| 6,579,210 | B1 | 6/2003 | Stearns et al. | |
| 6,626,802 | B1 * | 9/2003 | Rodgers, Jr. | 482/51 |
| 6,689,019 | B2 | 2/2004 | Ohrt et al. | |
| 6,761,665 | B2 | 7/2004 | Nguyen | |
| 6,926,646 | B1 | 8/2005 | Nguyen | |
| 7,112,161 | B2 * | 9/2006 | Maresh | 482/52 |
| 7,507,184 | B2 * | 3/2009 | Rodgers, Jr. | 482/52 |
| 7,520,839 | B2 * | 4/2009 | Rodgers, Jr. | 482/52 |

(Continued)

OTHER PUBLICATIONS

U.S. Appl. No. 60/780,599, filed Mar. 9, 2006, Rodgers, Jr.

(Continued)

*Primary Examiner* — Steve R Crow
(74) *Attorney, Agent, or Firm* — Fulbright & Jaworski L.L.P.

(57) ABSTRACT

An exercise apparatus comprises: a frame; a crank system comprising first and second crank system coupling locations, the crank system being supported by the frame; a right foot support member; a left foot support member; a first flexible support system comprising a first flexible element, the first flexible element coupled to the right foot support member and the first crank coupling location; and a second flexible support system comprising a second flexible element, the second flexible element coupled to the left foot support member and coupled to the second crank coupling location, and an adjustment assembly, wherein the user of the exercise apparatus may undertake a stepping motion or an instantaneously variable striding motion, and wherein the structural geometry of the exercise apparatus can be changed with operation of the adjustment assembly.

27 Claims, 6 Drawing Sheets

U.S. PATENT DOCUMENTS

| | | | | |
|---|---|---|---|---|
| 7,530,926 | B2 * | 5/2009 | Rodgers, Jr. | 482/52 |
| 7,641,598 | B2 * | 1/2010 | Rodgers, Jr. | 482/52 |
| 7,678,025 | B2 * | 3/2010 | Rodgers, Jr. | 482/52 |
| 2005/0049117 | A1 | 3/2005 | Rodgers, Jr. | |
| 2005/0124466 | A1 | 6/2005 | Rodgers, Jr. | |
| 2005/0124467 | A1 | 6/2005 | Rodgers, Jr. | |
| 2006/0217234 | A1 | 9/2006 | Rodgers, Jr. | |
| 2007/0219061 | A1 | 9/2007 | Rodgers, Jr. | |
| 2007/0219062 | A1 | 9/2007 | Rodgers | |

OTHER PUBLICATIONS

U.S. Appl. No. 60/881,205, filed Jan. 19, 2007, Rodgers, Jr.

* cited by examiner

ADJUSTABLE GEOMETRY EXERCISE DEVICES AND METHODS FOR USE THEREOF

CROSS-REFERENCE TO RELATED APPLICATIONS

This application claims priority to U.S. Provisional Patent Application 60/928,619, filed May 10, 2007 and entitled "LINKAGE AND CRANK SYSTEMS" and to U.S. Provisional Patent Application 61/072,564 filed Apr. 1, 2008 and entitled "LINKAGE AND CRANK SYSTEMS," the disclosures of which are hereby incorporated herein by reference.

TECHNICAL FIELD

The present description relates generally to an exercise device and, more particularly, it relates to a flexible element exercise device adjustable geometry.

BRIEF SUMMARY OF THE INVENTION

Various embodiments of the invention relate to flexible element exercise devices with adjustable geometry. In one example, an adjustable geometry system is coupled to the crank system and a foot support member.

In another example, a flexible element is coupled to a vertical support member.

In another example, a flexible element is coupled to a rocking support member.

In another example, a translating support assembly includes a flexible element.

An exercise device according to the present invention may have adjustable geometry that can be controlled by the user.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

In the following detailed description, reference is made to the accompanying drawings, in which are shown by way of illustration specific embodiments of the present invention. It should be understood that the detailed description and specific examples are intended for purposes of illustration only and are not intended to limit the scope of the invention. Numerous changes, substitutions, and modifications may be made without departing from the scope of the present invention.

Exercise devices that utilize flexible elements are described in U.S. Patent Application Publication Nos. US 2006/0217234 A1 by Rodgers, Jr., US 2007/0219061 A1 by Rodgers, Jr., and US 2007/0219062 A1 by Rodgers, Jr., each of which is incorporated by reference as if fully set forth herein. These referenced applications describe flexible exercise devices that utilize flexible elements in the coupling of crank systems to foot support members. Such exercise devices in this specification are referred to as flexible element exercise devices. Users of these flexible element exercise devices may cause rotation of the crank systems by undertaking stepping and/or striding motions. The right side foot support member may be coupled to a first crank arm through a first flexible element, and the left foot support member may be coupled to a second crank arm through a second flexible element. Flexible element exercise devices may have instantaneously variable foot paths where the length of the foot path is controlled instantaneously by the amount of force applied by the user to the foot support member. The family of variable foot paths that may be generated by a flexible element exercise device is defined by the specific geometry of the device.

Figure 1A:
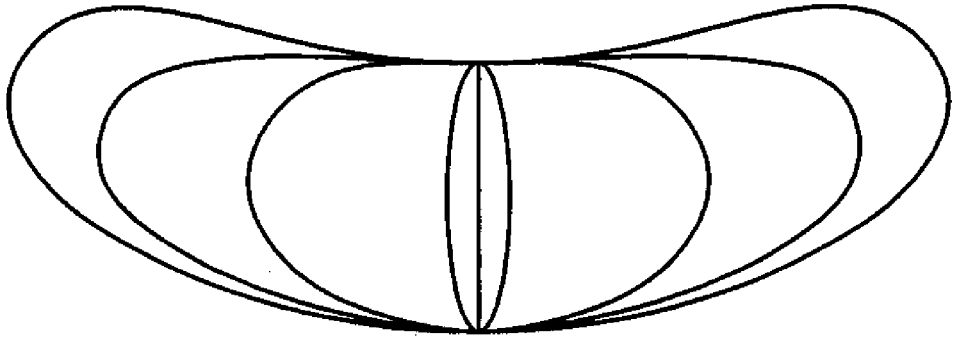
FIG. 1*a* depicts a family of foot paths.

FIG. 1*a* shows an example of a family of paths that may be taken by a user's foot on a flexible element device (e.g., a device according to one embodiment of the invention) having a specific structural geometry. Ordinary human-induced striding motion is rarely precisely uniform. It is generally rare for a user's foot path on a flexible element variable stride exercise device to meet up at its exact beginning (thereby tracing a precisely closed path). However, when attempting to maintain a constant path, a user's path over time can be expected to trace a set of approximately repeated curves, resulting in a recognizable "substantially closed path" which will be referred to in this description as "closed path". The family of closed paths shown in FIG. 1*a* is represented by four closed paths and a vertical path, but the family is not limited to only these. There are many possible closed paths within this family intermediate to the paths shown. The length, or horizontal amplitude, of a closed path within a family of paths will be determined by the force applied to the foot member by the user. The vertical path is typically perceived by the user as an almost pure vertical stepping motion. The height of this vertical stepping motion for the purposes of this discussion is the vertical amplitude of the stepping motion.

For many embodiments of the present invention, the force applied to the foot plates of the exercise device determines the path that the user's foot traces. Thus, as a user exercises and applies varying levels of force throughout an exercise session, the paths within a family will instantaneously and continually change. There are a large number of paths associated with a given family of paths, and the characteristics of a given family are a function of the structural geometry of the particular flexible element device that traces the paths. Structural geometry in the context of this description means the dimensions and/or locations of critical portions of the flexible element exercise device. Critical portions of the flexible element device can include, among other things, the flexible elements, the crank system, the guide elements, the support elements, and links/linkage assemblies. When the dimensions or the locations of any of the critical portions of the flexible element device are altered, the shape and characteristics of the family of paths may also be altered. It is understood that during a typical exercise session, the user's stride will affect the positions in space of the various portions of the device. However, in this context, the structural geometry refers to dimensions and/or locations of critical portions without regard to movement caused by striding.

Figure 1B:
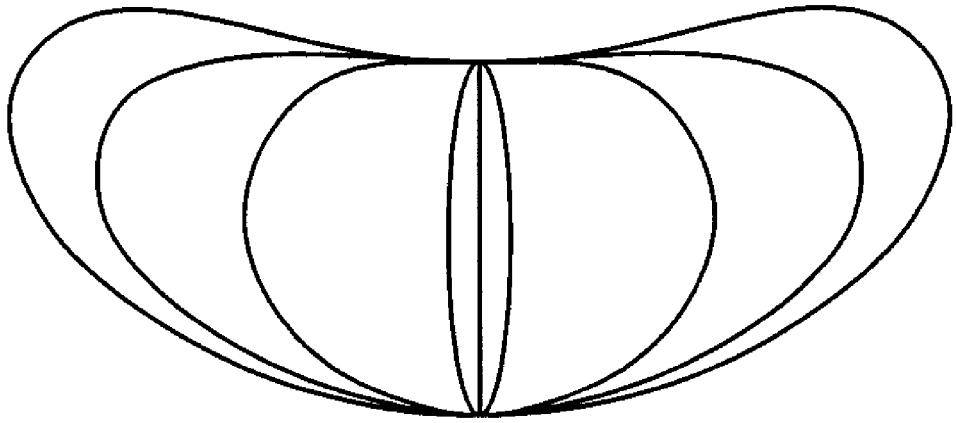
FIG. 1*b* depicts another family of foot paths.

FIG. 1*b* shows an example of a family of paths that is different than that of FIG. 1*a*. Although the basic shapes are similar, the family in FIG. 1*b* is generally taller, or higher and may be traced by a user exercising on a device according to an embodiment of the invention. The vertical amplitude of the stepping motion FIG. 1*b* is larger than that of FIG. 1*a*. The user of the flexible element device having a FIG. 1*b* family of paths would feel as though the stepping/striding motion is deeper and, for the same exercise cadence and brake system resistance, more difficult than the FIG. 1*a* family of paths. In other words, a different family of paths will have a different "feel" to the user. Therefore, a flexible element exercise device that has adjustable structural geometry may alter the family of paths generated and therefore change the feel of the exercise device.

Figure 2:
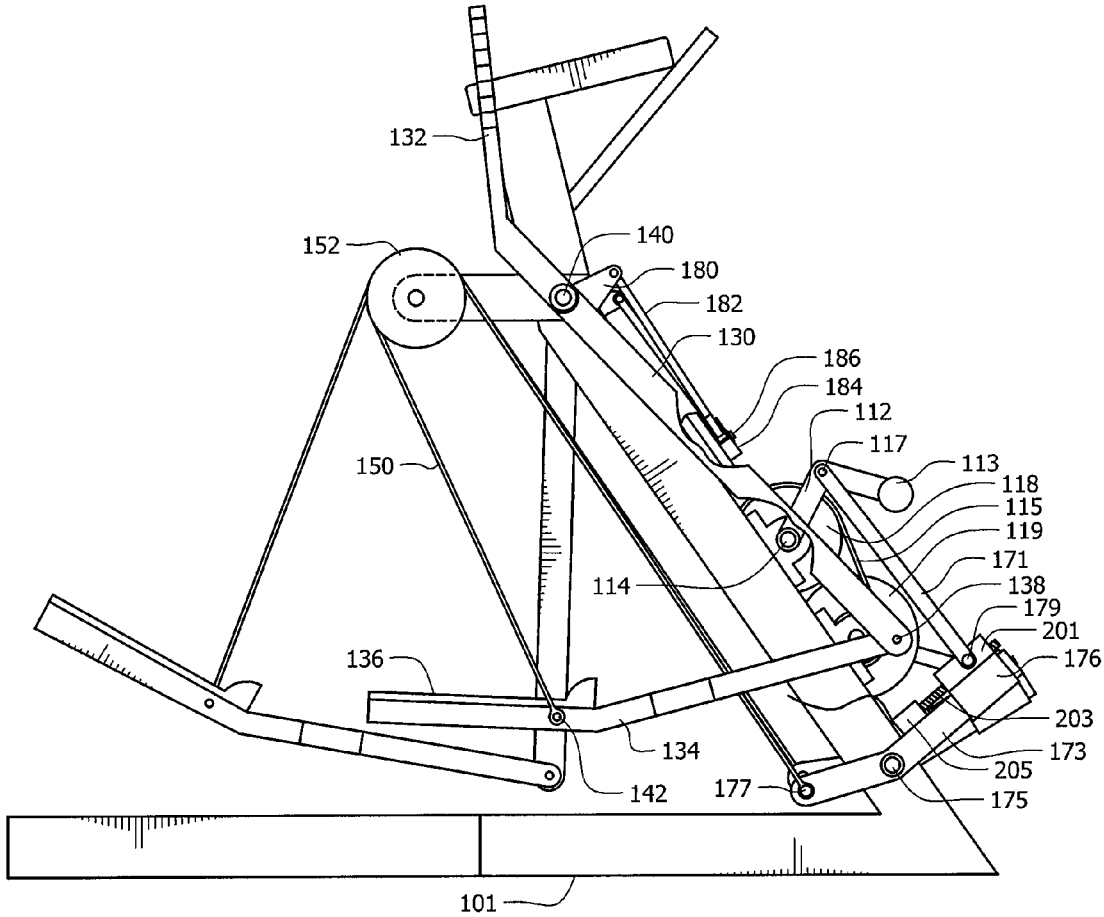
FIG. 2 depicts a side view of an example embodiment of an exercise device adapted according to an embodiment of the present invention.

FIG. 2 shows a side view of an example exercise apparatus according to one embodiment of the present invention. Frame 101 includes a basic supporting framework. The lower portion of frame 101 engages and is supported by the floor. A crank system includes crank members 112 attached to crank shaft 114. Although only one crank arm is numbered, it is understood that there is an opposing crank arm. Crank shaft 114 is supported by frame 101 so that the crank shaft may rotate about its longitudinal axis. One of crank arms 112 includes counterweight 113.

Although the embodiment shown in FIG. 1 utilizes a crank shaft with crank arms, other crank system configurations can be utilized. A crank system will typically have an axis of rotation and coupling locations away from the axis so that force applied at the coupling locations creates torque and rotary motion about the axis. As an example, a crank system could have multiple arms. Alternately, a crank system could be a disc with a central shaft and with coupling locations near the periphery which effectively act as crank arms. Alternately, a crank system could be a ring supported by rollers; the ring could have coupling locations near the periphery which effectively act as crank arms. Alternately, certain planetary gear systems may function as a crank system having a crank system axis and coupling locations near the periphery.

In this example, the crank system also includes brake/inertia device 119 coupled to crankshaft 114 through belt 115 and pulley 118. Rotation of crank arms 112 about the axis of crankshaft 114 causes rotation of brake/inertia device 119. Brake/inertia device 119 provides a braking force that provides resistance to the user during exercise, and/or it provides inertia that smoothes the exercise by receiving, storing, and delivering energy during rotation. Although the embodiment shown in FIG. 1 uses a single brake/inertia device, it is possible to utilize multiple brake/inertia devices or to separate the braking and inertia functions between two or more devices.

An intermediate linkage assembly is coupled to the crank system. In this example, the intermediate linkage assembly includes connecting link 171 and actuating link 173. Connecting link 171 is coupled at one end to crank arm 112 at crank coupling location 117 and is coupled at its other end to servo/screw assembly 176 at coupling location 179. Servo/screw assembly 176 is mounted to actuating link 173 which is coupled to frame 101 at coupling location 175. Servo/screw assembly can be moved under user control so that the position of coupling location 179 on actuating link 173 is changed. Servo/screw assembly 176 includes a translating block 201 engaging lead screw 203 that is rotated by electric servo motor 205. When current is applied to servo motor 205, lead screw 203 rotates and causes translating block 201 to change position on actuating link 173. Repositioning of coupling location 179 can be accomplished in a variety of other ways, however. For example, repositioning can be performed manually using a pull pin to lock position. Additionally or alternately, a solenoid can be used to alter the position of coupling location 179. Further, adjustment can be accomplished under microprocessor control whereby the apparatus geometry is altered according to certain preprogrammed exercise parameters.

A pivotal linkage assembly includes arcuate motion member 130 and foot support member 134. Although only the elements of the right side pivotal linkage assembly are numbered, it is understood that there is a left side pivotal linkage assembly with comparable elements. Arcuate motion member 130 has upper portion 132 that can be used as a handle by the user. Arcuate motion member 130 may be straight, curved, or bent. Foot support member 134 has foot plate 136 on which the user stands. Foot support member 134 may be straight, curved, or bent. Foot support member 136 is coupled to arcuate motion member 130 at coupling location 138. Coupling may be accomplished with a pivotal pin connection as shown in FIG. 2 and may also be accomplished with any device that allows relative rotation between the arcuate motion member 130 and foot support member 134. Arcuate motion member 130 is coupled to frame 101 at coupling location 140. Coupling may be accomplished with shaft and bushing as shown in FIG. 2 and may also be accomplished with any device that allows rotation of arcuate motion member 130 relative to frame 101.

Flexible element 150 is shown in FIG. 2 as a cable. However, the invention is not so limited, as flexible element 150 may be any flexible component able to carry tension, such as, e.g., a belt, a cog belt, or a chain. Flexible element 150 may have some compliance in tension, such as a rubber belt, or it may have little compliance in tension, such as a chain. At one end, flexible element 150 couples to foot support member 134 at coupling location 142. At its other end, flexible element 150 couples to actuating link 173 at coupling location 177. Flexible element 150 engages guide element 152 which also functions as a support element. Guide element 152 may be any component that can guide or support a flexible element such as, but not limited to, a pulley, a cog belt pulley, a sprocket, a roller, or a slide block.

Arcuate motion member 130 may be oriented in a generally vertical position. In the context of this description, the term generally vertical means closer to vertical than horizontal. It is not necessary that arcuate motion member 130 be straight, nor is it necessary that any portion be exactly vertical.

Foot support member 134 may be oriented in a generally horizontal position. In the context of this description, the term generally horizontal means closer to horizontal than vertical. It is not necessary that foot support member 130 be straight, nor is it necessary that any portion be exactly horizontal.

During operation, the user ascends the exercise device, stands on foot plates 136, and initiates a climbing motion by placing his/her weight on one of foot plates 136. As the user steps downward, force is transmitted through flexible element 150 causing movement of actuating link 173 and connecting link 171. This then causes rotation of crank arm 112, crank shaft 114, and brake/inertia device 119. As the crank system continues to rotate, foot support members 134 and foot plates 136 alternately lift and lower with a vertical amplitude. This lifting and lowering motion simulates the lifting and lowering motion that a user's foot may undertake during walking, striding, jogging, and climbing. The user may instantaneously alter stride length by altering the forward and rearward force he/she applies to foot plates 136. The user may instantaneously select a nearly vertical step with little horizontal displacement, or he/she may instantaneously select a longer stride with greater horizontal displacement. When the user displaces the foot plates horizontally, the combined motions of lifting and lowering and horizontal displacement results in a closed path where the amount of horizontal displacement is instantaneously controllable by the user.

Handles 132 move in an arcuate pattern and may be grasped by the user. When the user stands stationary on foot plates 136 for an extended period of time, the crank system may settle into a locked "top dead center" condition. In such a circumstance, counterweight 113 may apply a downward force to push the crank system through the "top dead center" condition.

In this example, right and left foot members 134 are cross coupled through right and left arcuate motion members 130 so that right and left foot plates 136 move in opposition. Elements 180 are coupled to arcuate motion members 130. Thus, each of right and left elements 180 move in unison with each right and left arcuate motion member 130, respectively. Connectors 182 couple right and left elements 180 to the right and left sides of rocker arm 184. Rocker arm 184 is pivotally coupled at its mid portion to frame 101 at location 186. As arcuate motion members 130 move, connectors 182 cause a rocking motion of rocker arm 184. This rocking motion causes right and left arcuate motion members 130 to move in opposition thus cross coupling the right and left pivotal linkage assemblies.

The specific closed path traveled by the user's foot will vary depending on the amount and timing of the forward and rearward force applied by the user to the foot plates 136. However, the specific foot path traveled in the embodiment of FIG. 2 will be a member of a family of foot paths unique to the structural geometry of the flexible element exercise device. The structural geometry is determined by the position and dimensions of the flexible element, the crank system, the guide elements, the support elements, and the links and/or linkage assemblies. If the dimensions or the locations of any of the critical portions of the flexible element device are altered, the shape and nature of the family of paths may also be altered.

In the embodiment of FIG. 2, the structural geometry can be altered by the user. Servo/screw assembly 176, under user control, repositions coupling location 179 in relation to coupling location 175. If the distance between coupling locations 179 and 175 is reduced, the vertical amplitude of foot member 134 and foot plate 136 will be increased because the arcuate range of motion, i.e. the length of the arc traveled, of coupling location 177 has increased. Following a change in structural geometry by repositioning coupling location 179, a new family of foot paths is created. For example, the device can be adjusted through use of servo/screw assembly 176 to change from the family of footpaths of FIG. 1A to the family of footpaths of FIG. 1B. Each of the families of foot paths before and after the change in structural geometry of the embodiment of FIG. 2 is unique, just as each of the families of foot paths in FIGS. 1A and 1B is unique. Following the change in structural geometry described above, the user would feel as though the stepping/striding motion is deeper, and for the same exercise cadence, stride length, and brake system resistance, more difficult.

Figure 3:
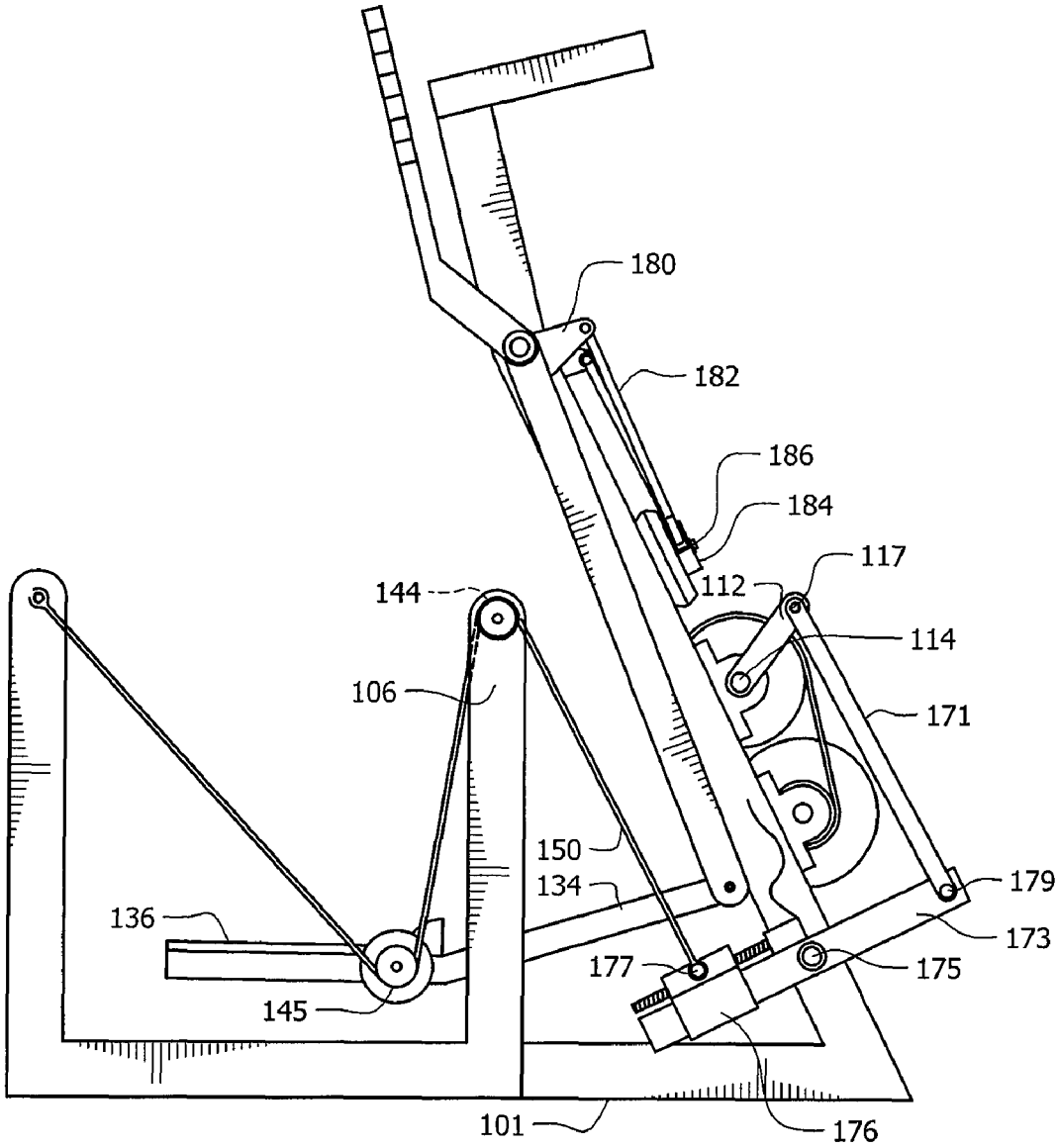
FIG. 3 depicts a side view of an example embodiment of an exercise device adapted according to an embodiment of the present invention.

FIG. 3 shows a side view of an example exercise apparatus according to one embodiment of the present invention. The embodiment of FIG. 3 has many elements that correspond to elements of the embodiments in FIG. 2, and those elements are numbered with similar numerals for similar elements. FIG. 3 omits most of the left side elements of the embodiment for visual clarity, but it is understood that there are left side elements comparable to the right side elements in this embodiment.

Flexible element 150 engages guide element 144 and also engages guide element 145 on foot support member 134. Flexible element 150 also couples to actuating link 173 at coupling location 177.

During operation, the user ascends the exercise device, stands on foot plates 136, and initiates a climbing motion by placing his/her weight on one of foot plates 136. As the user steps downward, force is transmitted through flexible element 150 causing movement of actuating link 173 and connecting link 171. This then causes rotation of crank arm 112, crank shaft 114, and brake/inertia device 119. As the crank system continues to rotate, foot support members 134 alternately lift and lower.

In the embodiment of FIG. 3, the structural geometry can be altered by the user. Servo/screw assembly 176, under user control, can reposition coupling location 177 in relation to coupling location 175. When the distance between coupling locations 177 and 175 is increased, the vertical amplitude of foot member 134 and foot plate 136 will be increased because the arcuate range of motion of coupling location 177 has increased. Following a change in structural geometry by repositioning coupling location 177, a new family of foot paths is created and the feel of the exercise device is changed.

Figure 4:
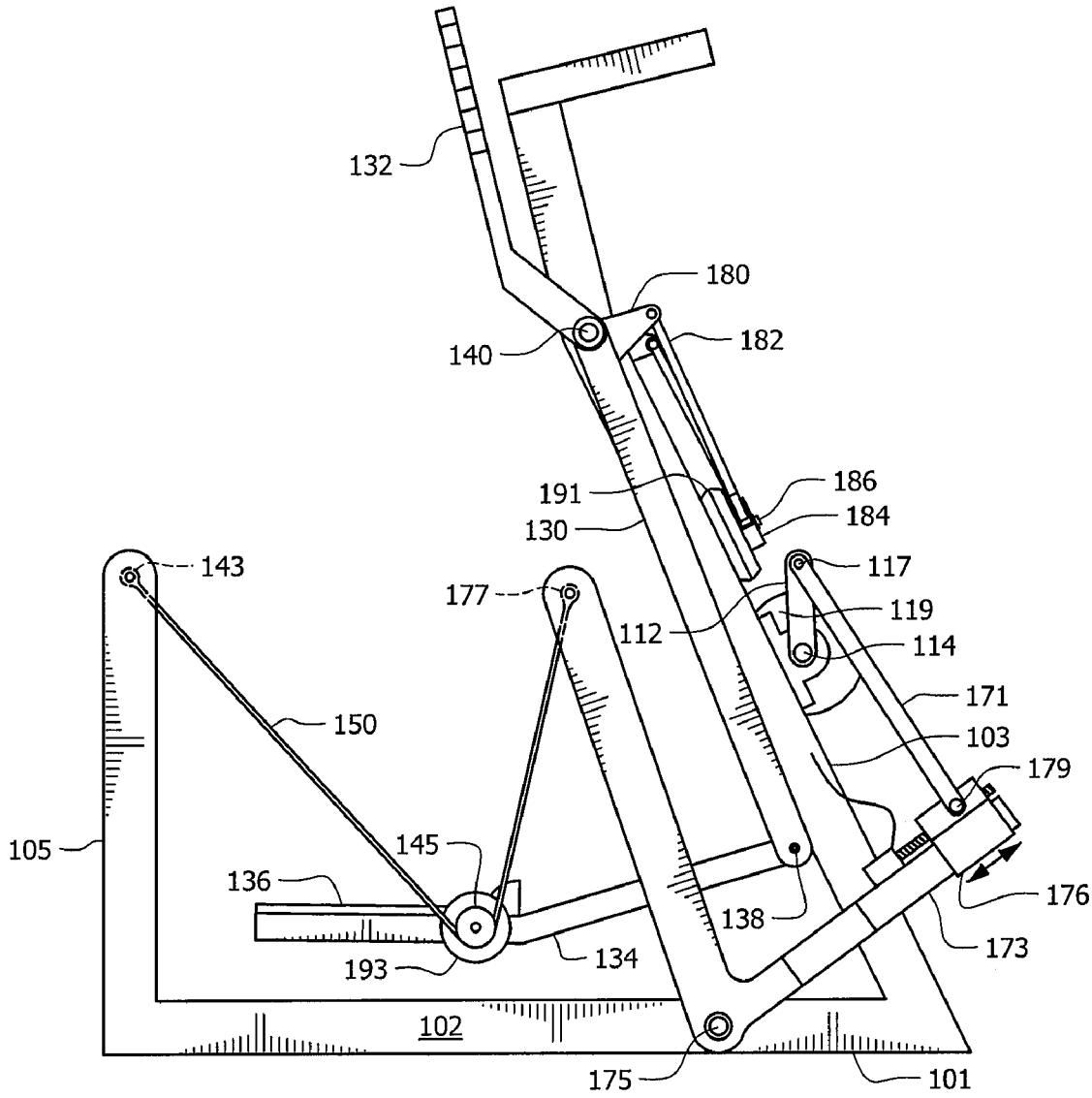
FIG. 4 depicts a side view of an example embodiment of an exercise device adapted according to an embodiment of the present invention.

FIG. 4 shows a side view of an example exercise apparatus according to one embodiment of the present invention. This embodiment has many elements that correspond to elements of the embodiments in FIGS. 2 and 3, and those elements are numbered with similar numerals for similar elements. FIG. 3 omits most of the left side elements of the embodiment for visual clarity, but it is understood that there are left side elements comparable to the right side elements in this embodiment.

Frame 101 includes a basic supporting framework including base 102, upper stalk 103, and vertical support 105. The lower portion of base 102 engages and is supported by the floor. The crank system includes crank members 112 attached to crank shaft 114. Crank shaft 114 is supported by frame 101 so that crank shaft 114 rotates about its longitudinal axis. Although not shown in FIG. 4, one of the crank arms may include a counterweight, as shown in FIG. 2.

In various embodiments a crank system may also include and/or be coupled to a brake/inertia device, such as device 119, coupled to the crank shaft. Alternately or additionally, a brake inertia device may be coupled to the crank shaft through a belt and pulley arrangement (not shown). Rotation of crank arms 112 about the axis of crank shaft 114 causes rotation of brake/inertia device 119. Brake/inertia device 119 provides a braking force that provides resistance to the user during exercise, and also provides inertia that smoothes the exercise by receiving, storing, and delivering energy during rotation.

An intermediate linkage assembly is coupled to the crank system. In this example, it includes connecting link 171 and actuating link 173. Connecting link 171 is coupled at one end to crank arm 112 at crank coupling location 117 and is coupled at its other end to servo/screw assembly 176 at coupling location 179. Servo/screw assembly 176 is mounted to actuating link 173 which is coupled to frame 101 at coupling location 175. Servo screw assembly 176 can be moved under user control so that the position of coupling location 179 on actuating link 173 can be changed.

A pivotal linkage assembly includes arcuate motion member 130 and foot support member 134. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138.

Referring still to FIG. 4, flexible element 150 couples to a support element at location 143 on vertical support 105. At its other end, flexible element 150 couples to actuating link 173 through a support element at support location 177. The support elements of FIG. 4 are shown as pins. Additionally or alternatively, other embodiments may choose support elements from rollers, pulleys, shafts, and other devices that are capable of supporting a flexible element. Between its ends, flexible element 150 engages guide element 145 located on foot member 134.

During operation, the user ascends the exercise device, stands on foot plates 136, and initiates an exercising motion by placing his/her weight on one of foot plates 136. As the user steps downward, force is transmitted through flexible support element 150 causing movement of actuating link 173 and connecting link 171. This then causes rotation of crank arm 112, crank shaft 114, and brake/inertia device 119. As crank shaft 114 continues to rotate, the horizontal position of support location 177 is continuously varied. This variation of the horizontal position of the support element at location 177 results in a lifting and lowering of the foot plate 136 and foot support member 134.

In the embodiment of FIG. 4, the structural geometry can be altered by the user. Servo/screw assembly 176, under user control, repositions coupling location 179 in relation to coupling location 175. Coupling location 177 traces a portion of a circle (an arcuate path) during exercise. When the distance between coupling locations 179 and 175 is reduced, the horizontal location and the amplitude of motion of coupling location 177 will be adjusted. Thus, when servo/screw assembly 176 is adjusted, the adjustment determines which particular portion of the circle is traced by coupling location 177. For example, one adjustment causes coupling location 177 to trace a portion of the circle that has a different horizontal position than its previous traced portion.

Figure 5:
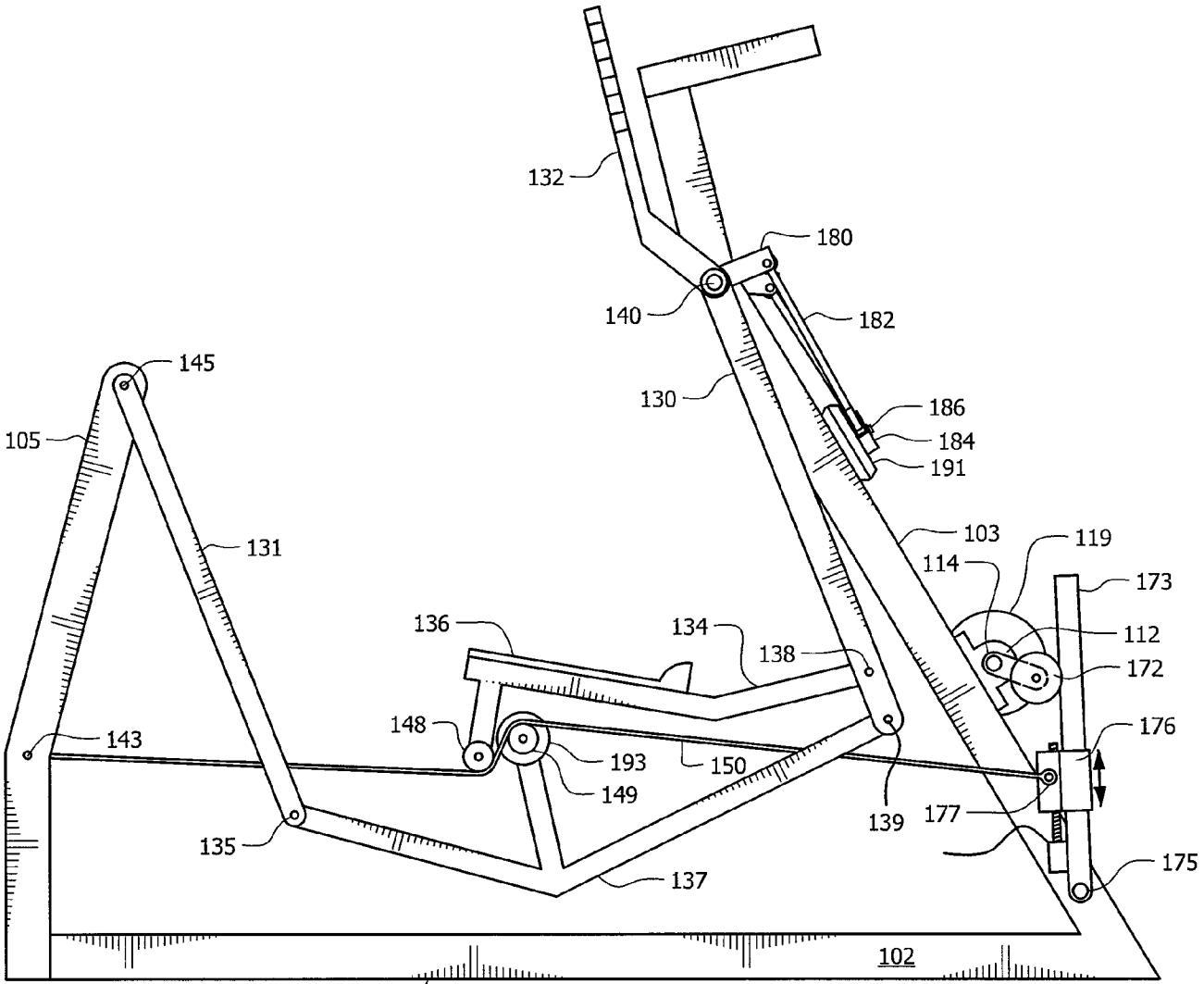
FIG. 5 depicts a side view of an example embodiment of an exercise device adapted according to an embodiment of the present invention.

FIG. 5 shows a side view of an example exercise apparatus according to one embodiment of the present invention. FIG. 5 omits most of the left side elements of the embodiment for visual clarity, but it is understood that there are left side elements comparable to the right side elements.

Frame 101 includes a basic supporting framework including base 102, upper stalk 103, and vertical support 105. The lower portion of base 102 engages and is supported by the floor. The crank system includes crank arms 112 attached to crank shaft 114. Crank shaft 114 is supported by frame 101 so that crank shaft 114 rotates about its longitudinal axis. Though not shown in this embodiment, one or both of crank arms 112 may include a counterweight, such as weight 113 (FIG. 2).

The crank system may also include a brake/inertia device, such as device 119. Alternately, a brake/inertia device may be coupled to crank shaft 114 through a belt and pulley. Rotation of crank arms 112 about the axis of crank shaft 114 causes rotation of brake/inertia device 119. Brake/inertia device 119 provides a braking force that provides resistance to the user during exercise, and/or it may provide inertia that smoothes the exercise by receiving, storing, and delivering energy during rotation.

An intermediate linkage assembly is coupled to the crank system. In this example it includes actuating link 173 and engagement roller 172. Actuating link 173 is coupled to frame 101 at location 175 and is coupled to crank arm 112 through engagement roller 172.

A translating support assembly includes foot support member 134, movable member 137, arcuate motion member 130, support link 131, and guide elements 148 and 149. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Movable member 137 is coupled to arcuate motion member 130 at location 139. Moveable member 137 is coupled to support link 131 at location 135. Support link 131 is coupled to vertical support 105 at location 145. Movable member 137 may be straight, curved, or bent. Arcuate motion member 130 is coupled to frame 101 at coupling location 140. Guide element 148 is coupled to foot support member 134 and guide element 149 is coupled to movable member 137.

Flexible element 150 is coupled at one end to vertical support 105 at location 143 and at its other end to servo/lead screw assembly 176 at location 177. Servo/lead screw assembly 176 is mounted to actuating link 173. Between its ends, flexible element 150 engages guide element 149 located on movable member 137 and guide element 148 located on foot member 134.

During operation, the user ascends the exercise device, stands on foot plates 136, and initiates an exercising motion by placing his/her weight on one or more of foot plates 136. As the user steps downward, force is transmitted to flexible support element 150 by guide element 148. In turn, flexible element 150 causes movement of actuating link 173. Movement of actuating link 173 causes rotation of crank arm 112, crank shaft 114, and brake/inertia device 119. As the crank system continues to rotate, foot support members 134 alternately lift and lower. This lifting and lowering motion simulates the lifting and lowering motion that a user's foot may undertake during walking, striding, jogging, and climbing. As each foot plate 136 continuously lifts and lowers, the user may simultaneously undertake a striding motion by applying a forward or rearward force to foot plates 136. This striding motion results in displacement of foot plates 136, foot members 134, movable members 137, and guide elements 148 and 149. The combination of displacement of the foot plates 136 by the user and the continuously lifting and lowering motion of foot plates 136 results in a substantially closed path. Supporting link 131 may be oriented in a generally vertical position. Such an orientation provides a restoring force that tends to restore the translating support assembly to a neutral position when the user applies weight to foot plate 136.

As in the embodiments of FIG. 2, FIG. 3, and FIG. 4, the right and left side pivotal linkage assemblies may be cross coupled so that the right and left foot plates 136 move in opposition.

In the embodiment of FIG. 5, the structural geometry can be altered by the user. Servo/screw assembly 176, under user control, repositions coupling location 177 in relation to coupling location 175. When the distance between coupling locations 177 and 175 is increased, the vertical amplitude of foot member 134 and foot plate 136 will be increased because the arcuate range of motion of coupling location 177 has increased. Following a change in structural geometry by repositioning coupling location 179, a new family of foot paths is created and the feel of the exercise device is changed.

Figure 6:
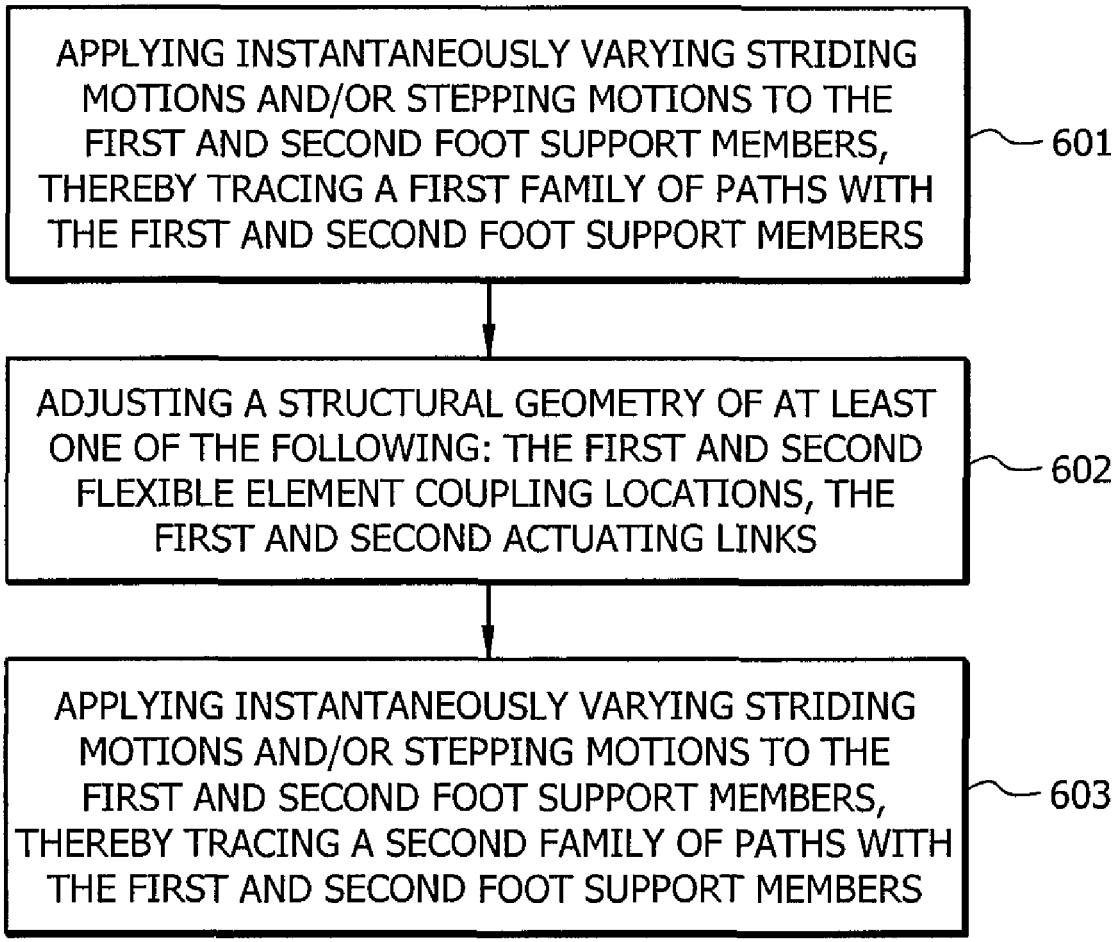
FIG. 6 is an illustration of exemplary method adapted according to one embodiment of the invention.

Various embodiments of the invention include methods for use of variable-stride exercise devices, such as those shown in FIGS. 2-5. FIG. 6 is an illustration of exemplary method 600 adapted according to one embodiment of the invention. Exemplary method 600 may be performed, for example, by a user exercising on a variable stride exercise device described above.

In step 601, the user applies instantaneously varying striding motion to the first and second foot support members, thereby tracing a first family of paths with the first and second foot support members. Additionally or alternatively, step 601 may include applying stepping motion to the foot support members to trace the first family of paths.

In step 602, the structural geometry of the exercise apparatus is adjusted. Step 602 may include, but is not limited to, changing a geometric relationship between coupling locations of the flexible elements and a crank linkage assembly (e.g., with the exercise devices of FIGS. 2 and 3), changing a geometric relationship between coupling locations of the flexible elements and a point of rotation of an actuating member (e.g., with the exercise device of FIG. 4), changing a geometric relationship between coupling locations of the flexible elements and a crank coupling location (e.g., with the exercise device of FIG. 5), and the like.

As mentioned above, step 602 can be performed manually and/or automatically, according to various embodiments. In one example, the user manually turns a screw assembly (e.g., 176 of FIG. 2) to adjust structural geometry of the exercise apparatus. In another example, the exercise apparatus includes a servo motor and/or other powered devices to assist the user in adjusting the screw assembly. In yet another embodiment, the exercise apparatus includes an electronic user interface that employs processor-executed logic to control structural geometry adjustment at the user's command and/or automatically in accordance with saved settings and algorithms. In fact, any technique for actuating an adjustment of geometry, with or without specific user commands or intervention, is within the scope of embodiments.

In step 603, the user applies instantaneously varying striding motion to the first and second foot support members, thereby tracing a second family of paths with the first and second foot support members. Additionally or alternatively, step 603 may include applying stepping motion to the foot support members to trace the first family of paths.

While method 600 is shown as a series of discrete steps, not all embodiments are so limited. It is within the scope of embodiments to add, modify, rearrange, or omit one or more steps. Thus, in one example, a user performs step 602 before mounting the exercise device, thereby skipping step 601. In another embodiment, the user adjusts the device as the user is exercising, thereby continuously progressing from step 601 to step 603.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An exercise apparatus allowing instantaneously variable striding motions, the exercise apparatus comprising:

a frame;

a crank system supported by the frame and adapted for continuous rotation;

a right foot support member comprising a right foot plate, the right foot support member coupled to the frame;

a left foot support member comprising a left foot plate, the left foot support member coupled to the frame;

a first flexible support system comprising a first flexible element, the first flexible element coupled to the right foot support member and the crank system and operative to rotate the crank system when the right foot plate moves downward;

a second flexible support system comprising a second flexible element, the second flexible element coupled to the left foot support member and the crank system and operative to rotate the crank system when the left foot plate moves downward; and an adjustment assembly providing adjustment of the structural geometry of the exercise apparatus;

wherein force is applied by a user to the right and left foot support members permitting the user to vary between a nearly vertical motion and a closed path striding motion, the length of the striding motion being instantaneously variable by the user when the user varies a forward and a rearward force applied to the foot support members, the vertical amplitude of the nearly vertical motion being controlled by the adjustment assembly.

2. The exercise apparatus of claim 1 wherein the adjustment assembly comprises a first intermediate linkage assembly and a second intermediate linkage assembly, the first flexible element coupled to the crank system through the first intermediate linkage assembly and the second flexible element coupled to the crank system through the second intermediate linkage assembly.

3. The exercise apparatus of claim 2 wherein the first intermediate linkage assembly comprises a first flexible element coupling location which is coupled to the first flexible element, and the second intermediate linkage assembly comprises a second flexible element coupling location which is coupled to the second flexible element.

4. The exercise apparatus of claim 2 wherein the first intermediate linkage assembly comprises a first linkage assembly crank coupling location which is coupled to the crank system, and the second intermediate linkage assembly comprises a second linkage assembly crank coupling location which is coupled to the crank system.

5. The exercise apparatus of claim 4 wherein the first linkage assembly crank coupling location is adjustable and the second linkage assembly crank coupling location is adjustable.

6. The exercise apparatus of claim 5 wherein the adjustment assembly further comprises a first servo and a second servo; and wherein the first servo adjusts the first linkage assembly crank coupling location and the second servo adjusts the second linkage assembly crank coupling location.

7. The exercise apparatus of claim 1 wherein the adjustment assembly changes the vertical amplitude of the foot plate.

8. The exercise apparatus of claim 1 wherein the exercise apparatus comprises a first support element and a second support element, the first support element engaging the first flexible element and the second support element engaging the second flexible element.

9. The exercise apparatus of claim 1 wherein the crank system comprises a crank shaft and two crank arms.

10. The exercise apparatus of claim 1 wherein the right and left foot members are coupled to the frame through respective linkage members.

11. The exercise apparatus of claim 1 comprising a brake/inertia system.

12. The exercise apparatus of claim 1 wherein the right and left foot plates are cross coupled by a cross coupling system to provide alternating motion.

13. The exercise apparatus of claim 12 wherein the cross coupling system is coupled to a brake.

14. The exercise apparatus of claim 1 wherein the first and second flexible elements are selected from the list consisting of:

a belt;

a cog;

a chain; and a cable.

15. An exercise apparatus allowing nearly vertical stepping motions and instantaneously variable striding motions, the exercise apparatus comprising:

a frame;

a crank system comprising first and second crank system coupling locations, the crank system being supported by the frame and adapted for continuous rotation;

a right pivotal linkage assembly comprising a right foot plate, the right pivotal linkage assembly coupled to the frame;

a left pivotal linkage assembly comprising a left foot plate, the left pivotal linkage assembly coupled to the frame;

a first flexible support system comprising a first flexible element, the first flexible element coupled to the right pivotal linkage assembly and the first crank system coupling location and operative to rotate the crank system when the right foot plate moves downward;

a second flexible support system comprising a second flexible element, the second flexible element coupled to the left pivotal linkage assembly and the second crank system coupling location and operative to rotate the crank system when the left foot plate moves downward; and an apparatus structural geometry adjustment assembly configured to change a vertical amplitude of the nearly vertical stepping motions;

wherein force is applied by a user to the right and left foot plates permitting the user to vary between the nearly vertical stepping motions and a closed path striding motion, the length of the striding motion being instantaneously variable by the user when the user varies a forward and a rearward force applied to the foot plates.

16. The exercise apparatus of claim 15 wherein the apparatus structural geometry adjustment assembly comprises a first intermediate linkage assembly and a second intermediate linkage assembly, the first flexible element coupled to the first crank system coupling location through the first intermediate linkage assembly and the second flexible element coupled to the second crank system coupling location through the second intermediate linkage assembly.

17. The exercise apparatus of claim 16 wherein the first intermediate linkage assembly comprises a first flexible element coupling location which is coupled to the first flexible element, and the second intermediate linkage assembly comprises a second flexible element coupling location which is coupled to the second flexible element.

18. The exercise apparatus of claim 16 wherein the first intermediate linkage assembly comprises a first linkage assembly crank coupling location which is coupled to the first crank system coupling location, and the second intermediate linkage assembly comprises a second linkage assembly crank coupling location which is coupled to the second crank system coupling location.

19. The exercise apparatus of claim 18 wherein the first linkage assembly crank coupling location is adjustable and the second linkage assembly crank coupling location is adjustable.

20. The exercise apparatus of claim 19 wherein the apparatus structural geometry adjustment assembly further comprises a first servo and a second servo; and wherein the first servo adjusts the first linkage assembly crank coupling location and the second servo adjusts the second linkage assembly crank coupling location.

21. The exercise apparatus of claim 15 wherein the crank system comprises a crank shaft and first and second crank arms, the first crank system coupling location on the first crank arm, the second crank system coupling location on the second crank arm.

22. The exercise apparatus of claim 15 wherein the right pivotal linkage assembly comprises a right foot support member and at least one right link, the right foot support member coupled to the frame through the right link and wherein the left pivotal linkage assembly comprises a left foot support member and at least one left link, the left foot support member coupled to the frame through the left link.

23. The exercise apparatus of claim 15 comprising a brake/inertia system.

24. The exercise apparatus of claim 15 wherein the right and left foot plates are cross coupled by a cross coupling system to provide alternating motion.

25. The exercise apparatus of claim 24 wherein the cross coupling system is coupled to a brake.

26. The exercise apparatus of claim 15 wherein the first and second flexible elements are selected from the list consisting of:

a belt;

a cog;

a chain; and a cable.

27. A method for using an exercise device that includes first and second foot support members respectively coupled to first and second flexible elements, the first and second flexible elements respectively coupled to first and second linkage assemblies at first and second flexible element coupling locations, the first and second linkage assemblies coupled to a crank assembly through first and second actuating links so that striding motions applied to the first and second foot support members cause the crank system to experience continuous rotation, the method comprising:

applying one or more of instantaneously varying striding motions and nearly vertical stepping motions to the first and second foot support members, thereby tracing a first family of paths with the first and second foot support members;

adjusting a structural geometry of at least one of the following: the first and second flexible element coupling locations, the first and second actuating links; and applying one or more of instantaneously varying striding motions and nearly vertical stepping motions to the first and second foot support members, thereby tracing a second family of paths with the first and second foot support members, wherein the first family of paths is traced before the adjusting, and wherein the second family of paths is traced after the adjusting, and wherein the first family of paths has a different vertical amplitude than the second family of paths.

* * * * *

UNITED STATES PATENT AND TRADEMARK OFFICE

CERTIFICATE OF CORRECTION

PATENT NO. : 7,988,600 B2
APPLICATION NO. : 12/116872
DATED : August 2, 2011
INVENTOR(S) : Robert E. Rodgers, Jr.

It is certified that error appears in the above-identified patent and that said Letters Patent is hereby corrected as shown below:

In the Specification:

Column 3, Line 51, delete the portion of text reading "FIG. 1" and replace with --FIG. 2--.

Column 4, Line 6, delete the portion of text reading "FIG. 1" and replace with --FIG. 2--.

Signed and Sealed this
Thirteenth Day of September, 2011

David J. Kappos

David J. Kappos
*Director of the United States Patent and Trademark Office*